United States Patent [19]

Hung

[11] Patent Number: 4,703,916

[45] Date of Patent: Nov. 3, 1987

[54] HYDRAULIC JACK STRUCTURAL IMPROVEMENT IN ONE-WAY HYDRAULIC PATH IN ASSOCIATION WITH SAFETY PRESSURE RELIEF NETWORK

[75] Inventor: Michael Hung, Taipei, Taiwan

[73] Assignee: Shinn Fu Corporation, Taipei, Taiwan

[21] Appl. No.: 874,015

[22] Filed: Jun. 12, 1986

[51] Int. Cl.[4] ..... B66F 3/24

[52] U.S. Cl. ..... 254/93 H

[58] Field of Search ..... 254/2 B, 8 B, 93 H; 417/307, 311

[56] References Cited

U.S. PATENT DOCUMENTS 3,757,523 9/1973 Resuggan ..... 254/93 H

*Primary Examiner*—Robert C. Watson

*Attorney, Agent, or Firm*—Browdy and Neimark

[57] ABSTRACT

Hydraulic jack with one-way Hydraulic Path in Association with safety pressure relief network, including a one-way valve in the hydraulic path, a plurality of steel balls, steel ball bumpers, compression springs, O rings and safety screws, to facilitate local control of the pressure in the hydraulic path. Correct current flow direction, and the realization of safely established pressure, is assumed by a more simple assembling procedure, at reduced costs and manhours.

11 Claims, 5 Drawing Figures

HYDRAULIC JACK STRUCTURAL IMPROVEMENT IN ONE-WAY HYDRAULIC PATH IN ASSOCIATION WITH SAFETY PRESSURE RELIEF NETWORK

DESCRIPTION OF THE INVENTION

The present invention relates to structural improvements in one-way hydraulic path in association with safety pressure relief network of a hydraulic jack, more specifically it means the provision of a hydraulic network comprising a one-way valve, a number of steel balls and steel ball bumpers, compression springs, O rings and safety screws in the pumping cylinder, such a provision serves to maintain correct flowing direction and safety in use, and which may be executed in vertical setting or horizontal setting in a jack of whatever construction, so as to promote processing precision and save processing costs.

In a conventional jack, the high pressure network and the low pressure network are provided severally and separate from each other, a one-way valve is provided in respective flow path, so as to account for a hydraulic circuit altogether, it is necessary to provide a pressure relief circuit in addition, to provide for the return of oils in the hydraulic cylinders to the oil reservoirs. In such a conventional hydraulic system, it is a usual practice to use steel balls alone as a one-way valve in the flow path. Besides, a conventional one-way valve serves primarily to prevent backflow, and permits unilateral flow only, failing to establish loading pressure that which is required to secure backfeeding of the released pressure in order to serve and observe the security feature of the jack.

Therefore, the primary object of the present invention is to provide structural improvement in one-way hydraulic path in association with safety pressure relief circuit of a hydraulic jack, the one-way valve hydraulic system enclosed in the pumping cylinder being composed of a one-way valve in conjunction with a number of steel balls, steel ball bumpers, compression springs, O rings, and safety screws; the safety screws serving to restrict the workload of the jack to a certain limit beyond which, that is, once such a limit is exceeded, the pressure heretofore established by the one-way valve will cause the overpressured hydraulic oil to be released, thereby keeping off overloading conditions at any time, maintaining the flow path in the correct direction at all times, so as to effect proper and sure control of the in-transit pressure.

A further objective of the present invention is to provide such an improved structure of the one-way valve in a conventional jack, in particular the one referred to above, such an improved one-way valve permissible to be a one-piece structure, and permissible for incorporation in the hydraulic system of differently styled jacks, be it vertical, horizontal, or separational, but will achieve in safe operation by the prevention of overloading and optimum control of the flowing path.

A further object of the present invention is to provide for a structural improvment of the one-way valve in a jack such as that defined in the foregoing, such a one-way valve hydraulic circuit can be produced in one-piece, permits testing exclusive of other elements, and for assemblage in the hydraulic circuit of the jack, so as to facilitate mass production at reduced costs conforming to economical requirements.

Other features and advantages of the present invention will emerge from the following descriptions of embodiments given by way of illustration, but not in any way limiting, with reference to the accompanying drawings in which.

Figure 1:
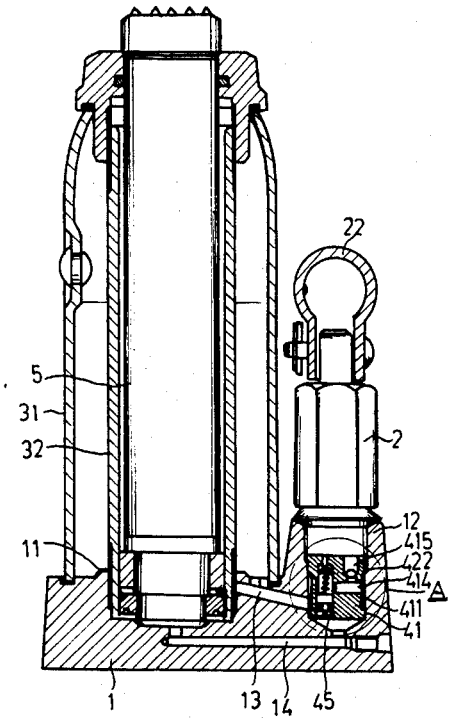
FIG. 1 is a longitudinal perspective of the invention embodied in a vertical hydraulic jack.
Figure 2:
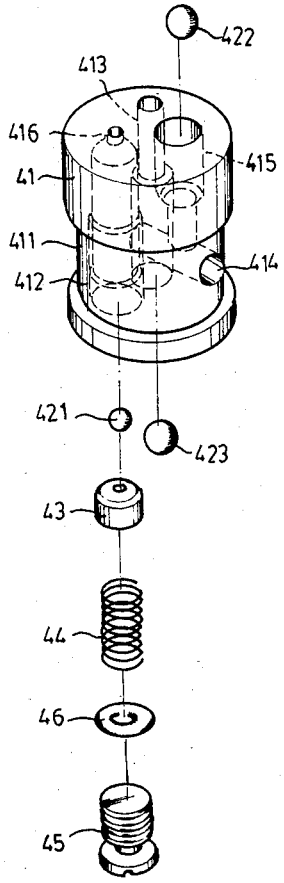
FIG. 2 is a break-away analytical view of the one-way valve structured hereunder.
Figure 3:
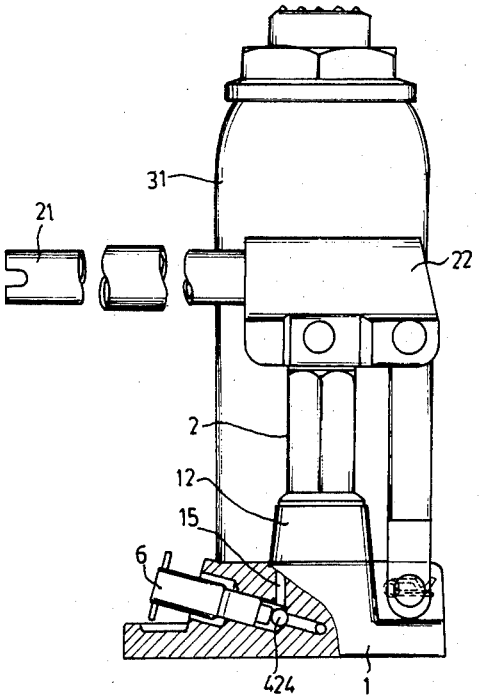
FIG. 3 is a side view of a hydraulic jack structured hereunder.

A brief description of the reference numbers follows:

1 base
12 pump seating
14 high pressure hydraulic path
2 pumping cylinder
22 shaft tubing
32 hydraulic tank
421, 422, 423 steel ball
44 compression spring
46 O ring
11 hydraulic cylinder seating
13 low pressure hydraulic path
15 pressure relief circuit
21 shaft sleeving
31 oil reservoir
41 one-way valve
43 steel ball bumper
45 safety screw
411 annular coulisse
412 radial ream
414 traverse guide hole
416 passage hole
6 adjusting valve
417 annular perimeter
413 radial anvil aperture
415 diverting guidle hole
5 lifter
424 steel ball
47 C ring Referring first of all to FIG. 1, FIG. 2, it is seen of the invention embodied in a vertical type jack, having a base 1, mounting for hydraulic cylinder 11 and pump seating 12, on the pump seating 12 is attached a pump 2, on which is attached a shaft sleeving 21 to yield increased pressure output under push by shaft tubing 22; in the base 1 is incorporated a low pressure circuit 13 and a high pressure circuit 14, plus a pressure relief circuit 15, shown in FIG. 3, on the hydraulic cylinder 11 is mounted an oil reservoir 31 having an oil tank therein, and containing a lifter 5 in said oil tank 32.

In the pump seating 12 is built a one-way valve circuit system, which consists of a one-way valve 41, three steel balls 421, 422, 423, a steel ball bumper 43, a spring 44, a safety screw 45 and O ring 46. Whereof the one-way valve 41 has an annular coulisse 411, reference is called to FIG. 4 at the same time, on the surface, and has a radial ream 412 and anvil aperture 413 provided, as well as a traverse guide hole 414 provided on the annular coulisse 411 and a radially provided diverting guide hole 415 that is associated with traverse guide hole 414. Of all these holes the radial ream 412 and the anvil aperture 413 are parallel to each other, but one end of the ream 412 is a passage hole 416 that is smaller than the full diametre of the ream hole, this in order to accommodate steel ball 42, steel ball bumper 43, spring 44 and safety screw 45, with a view to secure safety pressure releasing. The traverse guide hole 414 is in communication with radial ream hole 412, in order that the hydraulic oil be able to find its way into the diverting guide hole 415 via the hole 414 way up from the low pressure circuit 13, it will in the meantime serve as a discharge path for the hydraulic oil during releasing of pressure via radial ream hole 412.

In the radial ream hole 412 of the one-way valve 41 is accommodated by filling a steel ball 42 and associated steel ball bumper 43, the bumper 43 has an outer diameter that is smaller than the ream hole, for instance, for a ream hole 5.4 mm, tolerance 0 through plus 0.1 mm, the counterpart steel ball bumper should have an outer diameter of 5 mm, tolerance 0 through minus 0.1; the bumper bears against the steel ball by a push owing to the recharging of a cylindrical compression spring 44, so that the passage hole 416 is blocked out entirely; the compression spring 44, while in the ream hole 412, is compressed under a safety screw 45, the safety screw 45, locks by engagement with female screw tooth near the closer end of ream hole 412, the depth of a safety screw in the feeding determines the pressure to bear upon the compression spring 44, the deeper the feeding, the larger the pressure to bear upon spring 44, in the meantime greater stress will be binding upon steel ball 42 and steel ball bumper 43; on the contrary, a shallower feeding will bring smaller pressure to bear upon spring 44, accordingly, lesser stress to bear upon steel ball 42 and steel ball bumper 43. So it is necessary to adjust the feeding depth of safety screw 45 in order before the one-way valve circuit system is to be established in the pump seating 12.

Figure 4:
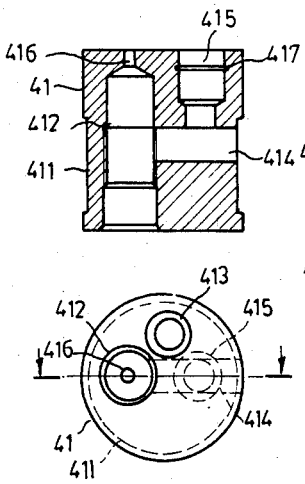
FIG. 4 illustrates both a side view and a cross-section view of the one-way valve structured hereunder.
Figure 5:
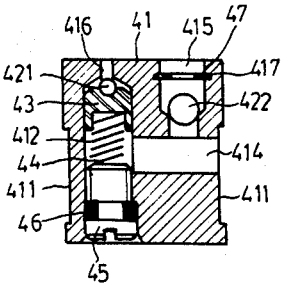
FIG. 5 is an enlarged view of that part denoted by the letter A in what is shown in FIG. 1 hereinbefore.

Referring to FIG. 1 again, it is seen that to bring the lifter 5 go upwards, you will have to feed the hydraulic oil stored in the oil reservoir 31 from the low pressure circuit 13 to the pump seating 12, as one-way valve mechanism is provided in the pump seating 12, so that oil will have to go through an annular coulisse 411 in the oneway valve 41 before it passes to the traverse guide hole 414, to be followed by passing into the guide hole 414, whereupon the steel ball 422 in the diverting guide hole 415 is open, noting that an annular perimeter 417 is enclosed around guide hole 415, to permit laying of a C ring 47, so as to prevent off-falling of steel ball 422, the steel ball 421 in the radial ream hole 412 is enclosed so that the hydraulic oil has to be fed into the pump chamber via guide hole 415; so that shaft tubing 22 may be inserted in the shaft sleeving 21 for up-and-down exertions, so that the pressurized hydraulic fluids, may flow down for feeding into high pressure hydraulic circuit 14 via one-way valve 41 relative to a radial anvil aperture 413, at this juncture the steel ball 423 in the aperture 413 is in an open condition, as shown in FIG. 4, so that the high pressure fluids may enter the hydraulic tank 32, thereby pushing the lifter 5 to lift up gradually. When it is intended to discharge the pressure, turn an adjustment valve 6 outside the Jack open to drive steel ball 424 of the pressure relief circuit open in success, so that the released fluids may flow via circuit 15 for storing in oil reservoir 31.

The structure disclosed thus far according to the invention makes possible both lifting and suction operations, it is characteristic in the provision of a pressure relief system in the one-way valve structure, which serves to prevent dangerous conditions that would otherwise prevail and manifest themselves in case the overall load of a jack surpasses the prescribed safe limit, say 3 to 15 tons, as depending upon the volumetric capacity of the jack, usually in the order of 0.5 to 30 t, as would with a conventional hydraulic jack. In more specific terms, for a jack structured according to the invention, in case of an overloading that should result in continual pushing of the shaft tubing 22, a portion of the high pressure oil would break through the steel balls 421 in the radial ream hole 412 of the one-way valve 41, so that the oil may find its way into the traverse guide hole 414 via ream hole 412, then recede into the low pressure circuit 13, thereby achieving pressure releasing, therefore safe employment of the prevailing pressure.

It is also because of that, the depth of feeding of safety screw 45 may determine the magnitude of the pressure to withstand in extreme conditions; also since that the determination of the depth of feeding of the safety screw 45 is based upon the grading of the jack model, so it is to be put into the pump seating upon completion of determination, to account rightly for a jack one-way valve hydraulic circuit structure that will definitely maintain the flow directions and safe use anytime.

To sum up, the present invention provides for the structure of a structural improvement in one-way hydraulic path in association with pressure relief network in hydraulic jack, which serves to maintain the flowing path under all circumstances and makes possible safe use of the working pressures any time it is therefore considered a highly worthwhile piece of invention.

I claim:

1. A hydraulic jack comprising a base having an aperture therein, said base having a pump and an oil tank with a lifter mounted thereon, said base further providing a high pressure circuit connecting a first part of said aperture to said oil tank and a low pressure circuit connecting a second part of said aperture to said pump, and a one-way valve inserted in said aperture, wherein said one-way valve comprises means for allowing oil to flow therethrough from said low pressure circuit via said pump to said high pressure circuit when said pump is operated, and for allowing oil in said pump to escape to said low pressure circuit when the operation of the pump causes oil pressure in the pump to exceed a predetermined value.

2. The jack of caim 1, said one-way valve comprising a traverse guide hole connected to a radal diverting guide hole and being in communication with one end of said low pressure circuit, an anvil aperture in communication with one end of said high pressure circuit, and a radial ream connected to said end of said low pressure circuit and through which said oil from the pump passes for the escape from said pump, a first ball in a first part of said radial diverting guide hole that is larger than a second part thereof, said second part being connected to said traverse guide hole, a second ball in a first part of said anvil aperture that is larger than a second part of said anvil aperture, said first part of said anvil aperture being connected with an end of said high pressure circuit, a third ball in a first part of said radial ream that is larger than a second part of said radial ream, said first part of said radial ream being connected to said traverse guide hole and said second part of said radial ream being adjacent said oil tank, and a spring in said first part of said radial ream for maintaining a bias against said third ball for determining said predetermined pressure.

3. The jack of claim 2, said aperture in said base and said one-way valve being cylindrical, and said cylindrical one-way valve having a coulisse on a cylindrical surface thereof to allow said low pressure circuit to connect with said traverse guide hole.

4. The jack of claim 2, said aperture in said base and said one-way valve being cylindrical, and said cylindrical one-way valve having a coulisse on a cylindrical surface thereof to allow said low pressure circuit to connect with said traverse guide hole.

5. The jack of claim 3, said aperture extending to receive a base of said pump in engagement with a top surface of said one-way valve at which said first part of said radial diverting guide hole ends and at which said second parts of said anvil aperture and said radial ream end.

6. The jack of claim 5, comprising said first part of said radial ream having a threaded end, and a screw engaging said threaded end for causing said spring to bias said third ball.

7. The jack of claim 6, comprising a bumper between said spring and said third ball.

8. The jack of claim 6, comprising each said ball being of steel.

9. The jack of claim 6, comprising each said ball and said bumper being of steel.

10. The jack of claim 6, comprising said radial diverting guide hole, anvil aperture and radial ream each being cylindrical, with said first and second parts thereof having respective different radii, and a seat for each respective ball between the respective first and second parts.

11. The jack of claim 6, comprising an oil reservoir connected to the other end of said low pressure circuit, and being located adjacent said oil tank, and a pressure relief circuit with an adjusting valve to allow oil in said oil tank to controlably return to said oil reservoir without passing through said one-way valve.

* * * * *